United States Patent [19]

Chun et al.

[11] Patent Number: 4,655,780

[45] Date of Patent: Apr. 7, 1987

[54] ENCAPSULATED BLEACH PARTICLES COATED WITH A MIXTURE OF $C_{16}$–$C_{18}$ AND $C_{12}$–$C_{14}$ FATTY ACID SOAPS

[75] Inventors: Kil Whan Chun, Wyckoff, N.J.; David J. Lang, Ossining, N.Y.; Edward Santos, Guttenberg, N.J.

[73] Assignee: Lever Brothers Company, New York, N.Y.

[21] Appl. No.: 815,423

[22] Filed: Dec. 31, 1985

[51] Int. Cl.[4] ..... C11D 3/395; C11D 11/00; B05D 1/02

[52] U.S. Cl. ..... 8/108.1; 252/91; 252/96; 252/97; 252/98; 252/174.13; 252/186.34; 252/186.35; 427/212; 427/213

[58] Field of Search ..... 252/91, 96, 97, 174.13, 252/186.34, 186.35; 8/108 R

[56] References Cited

U.S. PATENT DOCUMENTS

| | | | |
|---|---|---|---|
| 3,112,274 | 11/1963 | Morgenthaler et al. | 252/99 |
| 3,609,088 | 9/1971 | Sumner | 252/99 |
| 3,650,961 | 3/1972 | Hudson | 252/99 |
| 3,908,045 | 9/1975 | Alterman et al. | 427/213 |
| 3,933,670 | 1/1976 | Brill et al. | 252/99 |
| 3,959,165 | 5/1976 | Yurko | 252/109 |
| 3,971,726 | 7/1976 | Smith, Jr. et al. | 252/132 |
| 4,136,052 | 1/1979 | Mazzola | 252/94 |
| 4,237,024 | 1/1980 | Feaechko | 252/99 |

FOREIGN PATENT DOCUMENTS 911410 11/1962 United Kingdom .

*Primary Examiner*—Paul Lieberman
*Assistant Examiner*—Linda Skaling
*Attorney, Agent, or Firm*—Milton L. Honig; James J. Farrell

[57] ABSTRACT

Hard spherical bleaching particles are disclosed whose composition is an intimately dispersed agglomerated core mixture of an active halogen oxidizing material, an inorganic diluent salt and a binder. The cores are coated with a mixture of from about 70–85% of a $C_{16}$–$C_{18}$ fatty acid soap and from about 15–30% of a $C_{12}$–$C_{14}$ fatty acid soap. A method for bleaching substrates as well as a process for preparing the bleach particles are disclosed.

20 Claims, No Drawings

ENCAPSULATED BLEACH PARTICLES COATED WITH A MIXTURE OF $C_{16}$–$C_{18}$ AND $C_{12}$–$C_{14}$ FATTY ACID SOAPS

BACKGROUND OF THE INVENTION

1. Field of the Invention

The invention relates to coated halogen bleach particles and a method for bleaching substrates through slow uniform release of active halogenating agent from the particles.

2. The Prior Art

Particles containing oxidants for bleaching substrates have been widely disclosed in the literature. Much research has focused upon coating or encapsulating chlorinating agents, e.g. dichloroisocyanurate granules, to obtain delayed, slow release of active oxidant.

When used for cleaning clothes in automatic washing machines, several problems are noted with encapsulated oxidants. Low bleaching strength is encountered because of incomplete dissolution of the encapsulates during the standard wash cycle. Another problem is severe fabric color damage from the localization of released bleach. Generally, bleaching products are placed into the automatic washing machine simultaneously with the dry load. Bleach and fabric remain in close contact as the machine fills with water. Local high concentrations of bleaching actives thereby come into contact with fabric surfaces. Under these conditions, very small spots resembling pinholes appear on the fabric.

U.S. Pat. No. 4,136,052 (Mazzola) reports to have solved the pinhole problem caused by localized high concentrations of bleach. The patent provides a special coating which encapsulates the bleaching compound. An active chlorinating agent is surrounded by a first non-reactive coating combination of fatty acid and wax. A second time controlled coating is applied containing fatty acid with a material exhibiting inverse aqueous solubility with respect to temperature. The outer, second coating is more resistant to dissolution in hot than in cold water. By this means, sufficient delayed release is provided in hot water to prevent pinholing.

U.S. Pat. No. 3,908,045 (Alterman et al.) discloses dichloroisocyanurate salts encapsulated with a first coating of a saturated fatty acid surrounded by a second coating of soap. The latter coating is formed by treatment of portions of the inner fatty acid coating with a solution of an alkali metal hydroxide.

The prior art compositions of soap coated chlorine bleach provide adequate protection against pinhole type fabric damage only at low and medium wash temperatures. Unfortunately, at hot wash temperatures, pinholing is still a problem. It has been suggested that hot water pinholing results from non-uniform coating, fabric damage being caused by the inadequately encapsulated particle fractions. Uniformly coated particles have, so far, been unobtainable. To solve the problem, average coating weights have been increased by as much as 50% over the known art. Even these increased thicknesses do not ensure complete absence of pinholing at hot wash temperatures. Very thick coatings, which do control pinholing, are deficient because they hinder chlorine release at low wash temperatures and afford no bleaching.

Consequently, it is an object of the present invention to provide bleach particles which eliminate pinholing yet have satisfactory active halogen release at all wash temperatures.

A further object of this invention is to provide bleach particles that do not release active halogen oxidant during the water fill cycle of an automatic washing machine but subsequently completely release active oxidant within the wash cycle.

Another object of this invention is to provide a method for bleaching a variety of flexible or hard surfaced substrates.

SUMMARY OF THE INVENTION

Hard spherical bleaching particles are provided whose composition is an intimately dispersed agglomerated mixture comprising:

(i) from about 1 to 80% by weight of an oxidizing material having at least one reactive chlorine or bromine in its molecular structure;

(ii) from about 1 to 80% of an inorganic diluent salt;

(iii) from about 0.5 to 60% of a binder with melting point 85° to 120° F.; and (iv) from about 5 to 50% of a coating covering a core mixture of elements (i) through (iii) consisting essentially of a mixture of from about 70 to about 85% alkali metal $C_{16}$–$C_{18}$ fatty acid soap and from about 15 to about 30% $C_{12}$–$C_{14}$ alkali metal fatty acid soap.

DETAILED DESCRIPTION OF THE INVENTION

The present invention reports improved coatings to encapsulate core particles containing active halogen oxidizing agents. Encapsulation using a blend of fatty acid soaps of proper chain length has been found critical in guarding against pinhole damage while still maximizing dissolution rates to adequately release the oxidizing agent. The effective soap blend comprises a mixture of coconut $C_{12}$–$C_{14}$ chain length fatty acids with tallow $C_{16}$–$C_{18}$ chain length fatty acids. An increase in the coconut soap content of the coating increases the dissolution rate. Too much coconut soap, however, results in more pinhole damage. High tallow soap levels inhibit release of oxidizing agent from the core when particles are dispersed in water; bleaching is thereby adversely affected. Consequently, it is important to combine both types of soap to achieve a coating accentuating the advantages of each of the components.

The soap coating may be applied to the core material at a level from about 5% to about 50% by weight of the particle; preferably from about 20% to 40%; more preferably from about 25% to 35%. A coating of approximately 30 wt. % soap provides sufficient insulation thickness to adequately overcome pinhole damage. Substantially higher coating weights are wasteful. They only serve to inhibit early chlorine release during the wash cycle. Too little coating, of course, would release oxidant too rapidly.

Among the coconut type soaps useful for this invention are the alkali metal, alkaline earth metal, ammonium, $C_1$–$C_{12}$ alkyl ammonium and $C_1$–$C_6$ mono-, di- or tri-alkanol ammonium salts of coconut fatty acid. Coconut oil employed to prepare the soap may be obtained synthetically or from tropical nut oils including: palm kernel oil, babassu oil, ouricuri oil, tucum oil, cohune nut oil, murumuru oil, jaboty kernel oil, khakan kernel oil, dika nut oil and ucuhuba butter.

Tallow soaps include the alkali metal, alkaline earth metal, ammonium, $C_1$–$C_{12}$ alkyl ammonium and $C_1$–$C_6$ mono-, di- or tri-alkanol ammonium salts of $C_{16}$–$C_{18}$ fatty acids. Rich sources of these fatty acids are beef tallow, lard, olive oil and shea nut oil.

The soaps may contain some unsaturation; however, substantial unsaturation is to be avoided. Active halogen could be reactive with the unsaturated fatty acid soap. Sodium salts of the foregoing tallow and coconut fatty acids are particularly preferred.

The core material of the bleach particles is a granule comprising an oxidizing material, an inorganic diluent salt and a binder with melting point 85°–120° F. Oxidizing material is, to a substantial extent, hindered in release of active oxidizing agent by its dispersal in the diluent inorganic salt/binder matrix. There are, however, still surfaces where the oxidant is exposed and readily available for release.

The coating of the present invention, when combined with the core granule, improves control over oxidant release. The soap blend coating of this invention effectively retards release of oxidant during the fill cycle of most automatic washing machines. Dissolution rate of the coating varies little within the temperature range 70° to 135° F., the range of common wash temperatures. Good chlorine release characteristics are observed at all common wash temperatures during the wash cycle interval. The soap blend is also unreactive toward the oxidant; the blend provides a shield against oxidant loss during storage of encapsulated particles in detergent powder. With a protective coating of about 25–30% by weight of the total particle, pinhole damage is prevented during the typical 4-minute washing machine fill cycle, even at high wash temperatures. Thereafter, particles dissolve rapidly during the agitation wash cycle. High levels of bleaching agent are therefore available through most of the wash cycle.

The oxidizing material is one having at least a reactive chlorine or bromine atom in its molecular structure. Among the suitable halogen donor bleaches are heterocyclic N-bromo and N-chloro imides such as trichlorocyanuric, tribromocyanuric, dibromocyanuric and dichlorocyanuric acids, and salts thereof with water-solubilizing cations such as potassium and sodium.

Other N-bromo and N-chloro imides may also be used such as N-brominated and N-chlorinated succinimide, malonimide, phthalimide and naphthalimide. Other compounds include the hydantoins, such as 1,3-dibromo and 1,3-dichloro-5,5-dimethylhydantoin, N-monochloro-C,C-dimethylhydantoin methylene-bis(N-bromo-C,C-dimethylhydantoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro 5,5-isobutylhydantoin; 1,3-dibromo and 1,3-dichloro 5-methyl-5-n-amylhydantoin, and the like. Further useful hypohalite liberating agents comprise tribromomelamine and trichloromelamine.

Dry, particulate, water-soluble anhydrous inorganic salts are likewise suitable for use herein such as lithium, sodium or calcium hypochlorite and hypobromite.

The hypohalite liberating agent, may, if desired, be provided in the form of a stable solid complex or hydrate. Examples include sodium p-toluene-sulfobromoamine trihydrate, sodium benzene-sulfo-chloramine dihydrate, calcium hypobromite tetrahydrate, calcium hypochlorite tetrahydrate, etc. Brominated and chlorinated trisodium phosphate formed by the reaction of the corresponding sodium hypohalite solution with trisodium phosphate (and water if necessary) likewise comprise efficacious materials.

Sodium dichloroisocyanurate is, however, the preferred bleaching source because of its great water solubility, high chlorine content and dry storage stability when combined with the other core components. Although it could be used, calcium hypochlorite is more reactive and tends to lose chlorine activity during storage. Coarse grade sodium dichloroisocyanurate is used so that there is a high recovery of proper mesh size particles. This material is commercially available under the trademark Clearon CDB, a product of the FMC Corporation.

Bleaching agents may be employed in admixtures comprising two or more distinct chlorine donors. An example of a commercial mixed system is one available from the Monsanto Chemical Company under the trademark designation "ACL-66" (ACL signifying "available chlorine" and the numerical designation "66", indicating the parts per pound of available chlorine). The material comprises a mixture of potassium dichloroisocyanurate (4 parts) and trichloroisocyanurate acid (1 part).

By the term reactive chlorine or bromine is meant any oxidant capable of releasing halogen in the form of free elemental chlorine or bromine under conditions normally used for detergent bleaching purposes. It must also be understood that the hard spherical bleaching particles of this invention are not limited to their utility for washing fabric. They may also be used on dentures, floors and a variety of other hard or soft surfaces requiring cleaning with a controlled release oxidant.

In addition to the aforedescribed halogen containing oxidants, there are numerous other similar materials well known in the art. The list is by no means exhaustive. For instance, suitable chlorine-releasing agents are also disclosed in the ACS monogram entitled "Chlorine—Its Manufacture, Properties and Uses" by Sconce, published by Reinhold in 1962.

When utilizing the particles of this invention in a detergent formulation, the desired chlorine level in a wash solution is about 10 to about 200 parts per million available chlorine. Preferably, the range is about 15 to 50 ppm for the most efficient utilization of chlorine containing material for detergents used with colored fabrics. These levels determine the amount of bleach particles which must be incorporated into a detergent formulation.

Anywhere from about 1 to 80% by weight of the total core material may be halogen containing oxidizing material. Preferably from about 1 to 50%, more preferably from about 2 to 40% of oxidizing material is present.

A number of different inorganic salts may be employed as the diluent. Examples include borates, nitrates, orthophosphates, tripolyphosphates, silicates, sulfates, zeolites and clays. Sodium salts of the foregoing diluents are preferred. These salts must be inert to oxidation. Sodium tripolyphosphate is an especially preferred diluent for the core granule. The inorganic salt diluent may be present from about 1 to 80% by weight of the total granule. Preferably, it should be present from about 10 to 60%.

A third essential element is a binder with a melting point between 85° to 100° F. Lauric acid is the binder of choice. It softens at common, low wash temperatures; yet, it is still solid at room temperature. Higher chain fatty acids do not release bound chlorine at low wash temperatures. Fatty acids with lower melting points do not keep the particles firm during subsequent fluidization and encapsulation processing. Dichloroisocyanurate is also stable when in contact with lauric acid during long periods of storage.

A particularly preferred binder is Emery 651, a product of the Emery Chemical Company, a Division of National Distillers Corporation. Emery 651 contains 96% lauric acid and 3% myristic acid; the melting point of this material is 106°–109° F.

Suitable binders may also be found among organic homopolymers and copolymers. An example of a suitable homopolymer is polyvinylpyrrolidone.

A preferred embodiment of the core granules is one comprising a combination of dichloroisocyanurate, sodium tripolyphosphate and fatty acid binder. When these components are processed at temperatures above the fatty acid melting point, the surface tension of the resultant mixture is sufficient to render the granules spherical. No reaction occurs between the aforementioned components.

Core material is typically prepared by combining a bleaching agent such as sodium dichloroisocyanurate with sodium tripolyphosphate and lauric acid in a rolling drum mixer. After brief mixing of components by rotation of the drum, heated air is blown through the composition until a temperature is attained slightly above the melting point of the fatty acid. Agglomeration of the tripolyphosphate and fatty acid binder around the dichloroisocyanurate granules is thereby accomplished. A combination of surface tension and action of the rotating drum causes the core components to draw together into spherical particles. These are then cooled. The particles are screened to 18–25 U.S. Mesh with about 70% recovery. Oversized agglomerates constitute the remaining 30%; these may be ground and recycled back to the mixer. Diluted core particles may be stored for subsequent encapsulation. They are completely stable under cool, dry storage conditions.

Encapsulation of the diluted core granules with the soap blend may be performed by a variety of methods. A particularly preferred method is by the use of a spouted fluidized bed apparatus.

The soap blend is dissolved in water to provide a solution of concentration from about 5 to 40%; preferably a soap solution of 15 to 30%. Soap is then sprayed through an atomizing nozzle onto fluidized core granules held in the spout of the fluid bed. Water is continuously removed by the action of hot fluidized air passing through the bed. Bed temperatures are initially kept at 10°–15° F. below the melting point of the fatty acid binder so that it will not melt and cause agglomeration of the particles. Drying rates are accordingly adjusted. Once the core granules have received an approximate 10% coating, temperatures are increased to around 140° F.; this permits an increased rate of application of coating resulting from increased drying rates at the elevated temperatures. After the targeted soap blend thickness has been applied, the encapsulates are fluidized for an additional 10–15 minutes to complete drying. A final water content of around 7% may still be present in the particles. Storage stability is unaffected by this level of water.

If desired, additional coatings may be applied to envelope the prime coating of soap. For instance, the additional coating may be selected from a cellulose material, organic homopolymers or copolymers, and mixtures thereof. Suitable cellulose materials may include hydroxypropyl cellulose, hydroxypropylmethyl cellulose, hydroxybutyl cellulose and carboxymethyl cellulose. Examples of co-polymers that may be employed include styrene-maleic monoalkyl esters, styrene-acrylic copolymers, maleic anhydride-acrylic copolymers and acrylic-methacrylic copolymers. Homopolymers may include polystyrene, polyacrylate, polymethacrylate and polyvinylpyrrolidone.

Bleach particles of the present invention may be incorporated into a detergent composition containing surfactants, soaps, builders, enzymes, filler materials and other minor functional laundering agents commonly found in such compositions.

Surfactants present in these detergent compositions may be found in an amount from about 2% to 50% by weight, preferably from 5 to 30% by weight. These surfactants may be anionic, nonionic, zwitterionic, amphoteric, cationic or mixtures thereof.

Among the anionic surfactants are water-soluble salts of alkylbenzene sulfonates, alkyl sulfates, alkyl ether sulfates, paraffin sulfonates, α-olefin sulfonates, α-sulphocarboxylates and their esters, alkyl glycerol ether sulfonates, fatty acid monoglyceride sulfates and sulfonates, alkyl phenol polyethoxy ether sulfates, 2-acyloxy-alkane-1-sulfonates and β-alkoxy alkane sulfonates.

Nonionic surfactants are water-soluble compounds produced by the condensation of ethylene oxide with a hydrophobic compound such as an alkanol, alkylphenol, polypropoxy glycol or polypropoxy ethylene diamine. Examples of nonionic surfactants are the condensation products of ethylene oxide, propylene oxide and/or butylene oxide with $C_8$–$C_{18}$ alkyl phenols, $C_8$–$C_{18}$ primary or secondary aliphatic alcohols, $C_8$–$C_{18}$ fatty acid amides. The average moles of ethylene oxide and/or propylene oxide present in the above nonionics varies from 1 to 30; mixtures of various nonionics, including mixtures of nonionics with a lower and a higher degree of alkoxylation may also be used.

Cationic surfactants include the quaternary ammonium compounds having one or two hydrophobic groups with 8–20 carbon atoms, e.g. cetyl trimethylammonium halide or methosulphate; dioctadecyl dimethylammonium halide or methosulfate; and the fatty alkyl amines.

Zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group. Examples are alkyl dimethyl propane-sulfonates and alkyl dimethyl ammoniohydroxypropane-sulfonates wherein the alkyl group in both types contains from about 1 to 18 carbon atoms.

Conventional alkaline detergency builders, inorganic or organic, may be found in these compositions at levels from about 2 to 80%, preferably from 10 to 50% by weight. Inorganic builders include water-soluble alkali metal phosphates, polyphosphates, borates, silicates and carbonates. Organic builders include: (1) water-soluble amino polycarboxylates, e.g. sodium or potassium ethylene diamine tetraacetates, nitrilotriacetates and N-(2-hydroxy)ethyl nitrilodiacetates; (2) water-soluble salts of phytic acid; (3) water-soluble polyphosphonates such as salts of ethane-1-hydroxy-1,1-diphosphonic acid; methylene diphosphonic acid salts; ethylene diphosphonic acid salts and ethane-1,1,2-triphosphonic acids salts; (4) water-soluble salts of polycarboxylate polymers and copolymers. Certain aluminosilicates such as synthetic zeolites can also be used.

Adjunct materials commonly used in detergent compositions may be incorporated. These include soil suspending agents such as water-soluble salts of carboxymethyl cellulose, copolymers of maleic anhydride with vinyl ethers, and alkyl or hydroxyalkyl cellulose ethers. Other adjuncts include colorants, perfumes, lather boosters, anti-foam agents, optical brighteners, anti-oxidants and anti-corrosion inhibitors.

The following examples will more fully illustrate the embodiments of the invention. All parts, percentages and proportions referred to herein and in the appended claims are by weight unless otherwise indicated.

EXAMPLE 1

Preparation of Core Granules

Core particles were found to be best prepared by a rolling drum process. This method provides strong, coherent core particles capable of withstanding a subsequent coating operation in a fluid bed. The process involves passing heated air (about 85° to 150° F.) through a rolling drum filled with a mixture of granular halogen bleaching agent, inorganic salt diluent and a low melting fatty acid (binder). As the fatty acid melts, it combines with the inorganic salt to intimately encase the chlorinating agent. A nearly spherical core agglomerate is thereby created. Specific details of the process are hereinafter described.

A 4-foot long, 2-foot diameter rolling drum mixer was employed for the agglomeration. The drum was fitted with 6-inch spiral baffles to promote better mixing. A small motor rotated the drum at 32.5 rpm. Core particles were formed in batch runs of 50 lb. raw material charge. Each charge consisted of 35 lbs. of coarse or fine-coarse Clearon CDB granules, 10 lbs. of sodium tripolyphosphate and 5 lbs. of Emery 651 fatty acids. These materials were thoroughly blended by rotation of the drum for 10 minutes. Hot air was then blown through the drum to heat the core mixture.

As the temperature rose to the melting point of the fatty acids, the molten fatty acid mixture with sodium tripolyphosphate formed a coating around the Clearon CDB particles. After the reactant blend had reached 110° F., it was allowed to cool with continuing drum rotation. Upon cooling, there resulted hard, coherent, nearly spherical particles. These particles were screened to obtain sizes in the range 18–25 U.S. Standard Mesh with 30–70% of theoretical recovery. Measured chlorine content of the core particles ranged from 42 to 48%.

Encapsulation Step

A 1.3 kilogram charge of core agglomerated granules were placed in an Aeromatic Strea-1 Fluid Bed. A mixture of tallow/coconut fatty acids of 80/20 ratio were dissolved at 75° C. in water to provide a 22% solution. Core granules were fluidized under agitation of an air flow at 55 cfm held at 30° C. The bed was well fluidized under these conditions. Coating commenced by spraying the soap solution onto the fluidized core granules from a spray nozzle located above the bed. Initially, the spray rate was held at 3 ml/min. This rate was maintained for about 68 minutes; approximately 3 wt. % of coating was achieved at this point known as the "initial coating stage". Fluidization during this and the subsequent stage was difficult due to the low attainable drying rates. Subsequently, the spray rate could be increased to a maximum of 8 ml/min. at 30° C. During this stage, the coating thickness was sufficient to completely cover the core granule surface. With the contiguous coating, binder tackiness was eliminated thereby improving fluidization. The bed was operated at the aforementioned spray rate for approximately 87 minutes until a 10–12 wt. % soap coating had deposited; this stage is termed the "low temperature coating stage".

The coating was now thick enough to overcome melting effects of fatty acid binder within the interior of the encapsulate. Temperatures and spray rates could now gradually be increased to 60° C. and a maximum of 25 ml/min. Evaporation rates were greatly increased due to the higher bed temperature. Fluidization at this point was excellent. Operation of the bed under these conditions was continued for an additional 75 minutes. The final coating reached 30 wt. %.

Further drying was performed at high temperature for an additional 10 minutes. Total encapsulation time was approximately 4 hours. Free flowing encapsulated particles were obtained having approximately 25% active chlorine. There was a 4% active chlorine loss in the process due to the interaction of water solvent with the exposed core surface during the initial stage of encapsulation.

EXAMPLE 2

Pinhole Test

Pinholing was evaluated by placing the bleach particles on denim cloth swatches for four minutes in wash water held at specified temperatures. Denim cloth was used in the test because the dark navy dyes in the cloth are very susceptible to bleach damage. Temperatures used to simulate actual wash conditions were: hot—135° F.; warm—100° F.; cold—70° F. After the bleach particles had remained on the cloth underwater for 4 minutes in an unagitated state, they were agitated for 1 minute. Thereafter, the denim was removed from the wash water, rinsed and inspected for fabric dye damage. No effect on the coloring of the denim cloths was designated as excellent protection by the encapsulate coating. Overall lightening of the cloth was designated as good. Very light, localized spots was designated as slight pinholing. Appearance of very light, readily distinguishable spots was designated as poor protection. When the cloth turned brown and was "burned" by the high chlorine concentration, this was designated as very poor protection.

Chlorine Release Test

These tests were conducted by placing a small sample of the bleached particles in a flask with wash water at the wash temperature. The solution was gently agitated for 4 minutes by slow turning of the flask in a rotating flask apparatus. The treatment was intended to simulate the fill cycle of a typical washing machine.

Subsequently, a sample of wash water was withdrawn and titrated with sodium thiosulfate solution. Chlorine content was established by this titration. The speed of flask rotation was then increased to simulate the agitation cycle of a washing machine. At the 8, 12 and 16 minute marks, samples were withdrawn; these samples were titrated to establish chlorine content of the solution at each point of the wash cycle. The remaining solution including any remaining particles was then titrated to establish the extent of unreleased chlorine. The test provides a reliable indication of chlorine release expected in the non-agitated fill cycle and wash cycle of an automatic washing machine.

Performance of Encapsulated Bleach Granules

The compositions of various base soaps are outlined in Table I. Soaps A through F are identified by the content and nature of their fatty acid constituents. Coating weight percentages and the identity of the soap(s) blend employed is listed in Table II. Core compositions are identified in the footnote wherein Na TPP refers to sodium tripolyphosphate and CDB refers to Clearon CDB, the chlorinating agent.

Performance of the encapsulates is set forth in Table III.

A blend of 65% coconut Soap F and 35% tallow Soap E provided excellent chlorine release. However, the particles encapsulated therein dissolved so rapidly that pinholing damage was considerable at 135° F. wash temperatures. Coatings of Soap B, consisting of a 40/60 blend of coconut and tallow soaps, also provided good chlorine release. Pinhole damage, however, was unacceptable. Coatings of Soap A appear to have the best dissolution properties of the encapsulates evaluated. Chlorine release into the wash was good and pinhole protection was maintained at all wash temperatures. Soap A consists of a 20/80 blend of coconut and tallow sodium soaps. Soap A of Sample 7 was prepared by the aforedescribed encapsulation method except that water was replaced by acetone as the processing solvent. Acetone processed encapsulates provided better performance than those processed with water. Compare the 8 minute chlorine release value in Samples 1 and 7.

A further increase in tallow content reduced the performance of the encapsulate. A 10/90 blend of coconut and tallow sodium soaps (10% Soap F, 90% Soap E) provided pinhole protection. Unfortunately, the encapsulated particles did not dissolve at low wash temperatures (70° F.) resulting in poor chlorine release.

TABLE I

| | | Composition of Base Soaps | | | | | |
|---|---|---|---|---|---|---|---|
| Fatty Acid | Chain Length | Soap A | Soap B | Soap C (Tallow) | Soap D (Coconut) | Soap E | Soap F |
| Caprylic | $C_8$ | 1.2 | 2.7 | — | 6.8 | — | — |
| Capric | $C_{10}$ | 1.1 | 2.5 | — | 6.3 | — | 1.0 |
| Lauric | $C_{12}$ | 9.7 | 20.3 | 1.0 | 49.3 | — | 96.0 |
| Myristic | $C_{14}$ | 6.0 | 9.3 | 3.2 | 18.5 | 2.5 | 3.0 |
| Palmitic | $C_{16}$ | 22.6 | 19.0 | 25.6 | 9.0 | 50.0 | — |
| Margaric | $C_{17}$ | 1.0 | 0.7 | 1.2 | — | 1.5 | — |
| Stearic | $C_{18}$ | 16.5 | 12.6 | 19.6 | 2.2 | 45.5 | — |
| Palmitoleic | $C_{16:1}$ | 2.6 | 1.9 | 3.2 | — | — | — |
| Oleic | $C_{18:1}$ | 34.7 | 27.0 | 41.0 | 6.1 | — | — |
| Linoleic | $C_{18:2}$ | 2.1 | 1.5 | 2.5 | — | — | — |

*Chain lengths constituting less than 1% are not shown.

TABLE II

| | Encapsulate Coating of Core Granules | |
|---|---|---|
| Sample Encapsulate | Core Composition | Coating |
| 1 | I | 100% Soap A |
| 2 | I | 65% Soap F, 35% Soap E |
| 3 | I | 10% Soap F, 90% Soap E |
| 4 | I | 25% Soap F, 75% Soap E |
| 5 | II | 100% Soap B |
| 6 | II | 100% Soap A |
| 7 | I | 100% Soap A, (acetone solvent processed) |

I - 70% CDB; 20% Na TPP, 10% Emery 651
II - 10% CDB; 80% $Na_2SO_4$, 10% Emersol 132

TABLE III

| | Performance of Encapsulates | | | | | |
|---|---|---|---|---|---|---|
| | Temperature °F. | Pinholing Performance | Percentage of Chlorine Released Minutes 4 | 8 | 12 | 16 |
| Sample | | | | | | |
| 1 | 70 | Excellent | 0 | 19.0 | 94.4 | 99.6 |
| | 100 | Excellent | 0 | 90.1 | 100 | 100 |
| | 135 | Good | 2.0 | 95.9 | 100 | 100 |
| 2 | 70 | Good | 0 | 84.6 | 98.7 | 100 |
| | 100 | Good | — | — | — | — |
| | 135 | Very Poor | — | — | — | — |
| 3 | 70 | Excellent | 0.9 | 0.9 | 0.9 | 4.2 |
| | 100 | Excellent | — | — | — | — |
| | 135 | Excellent | 0.5 | 55.9 | 84.3 | 100 |
| 4 | 70 | Good | 0 | 4.5 | 29.5 | 52.4 |
| | 100 | Good | — | — | — | — |
| | 135 | Very Slight | 7.2 | 96.3 | 96.7 | 99.4 |
| 5 | 70 | Poor | — | — | — | — |
| | 100 | Very Poor | 8.0 | 31.6 | 59.0 | 84.1 |
| | 135 | Very Poor | — | — | — | — |
| 6 | 70 | Good | — | — | — | — |
| | 100 | Good | 4.3 | — | 63.7 | — |
| | 135 | Very Slight | 4.4 | — | 54.0 | — |
| 7 | 70 | Excellent | 0 | 45.1 | 89.9 | 96.6 |
| | 100 | Excellent | — | — | — | — |
| | 135 | Good | 2.7 | 98.5 | 99.3 | 100.0 |
| Unencapsulated Core I | | | | | | |
| 8 | 70 | Very Poor | 12.2 | 58.7 | 87.2 | 96.4 |
| | 100 | Very Poor | 100 | 100 | 100 | 100 |
| | 135 | Very Poor | 100 | 100 | 100 | 100 |

The foregoing description and examples illustrate selected embodiments of the present invention and in light thereof various modifications will be suggested to one skilled in the art, all of which are within the spirit and purview of this invention.

What is claimed is:

1. Hard spherical bleaching particles whose composition is an intimately dispersed agglomerated mixture comprising:

(i) from about 1 to 80% by weight of an oxidizing material having at least one reactive chlorine or bromine in its molecular structure;

(ii) from about 1 to 80% by weight of an inorganic diluent salt;

(iii) from about 0.5 to 60% by weight of a binder with melting point 85° to 120° F.; and (iv) from about 5 to 50% by weight of a coating covering a core mixture of elements (i) through (iii) consisting essentially of a mixture of from about 70 to about 85% by weight of alkali metal $C_{16}$–$C_{18}$ fatty acid soap and from about 15 to about 30% by weight of $C_{12}$–$C_{14}$ alkali metal fatty acid soap.

2. Particles according to claim 1 wherein the coating is present from about 25 to about 35% by weight of the total encapsulated particle.

3. Particles according to claim 1 wherein the oxidizing material is an alkali metal dichloroisocyanurate.

4. Particles according to claim 1 wherein the binder is lauric acid.

5. Particles according to claim 1 wherein the binder is selected from soap, polyvinylpyrrolidone and mixtures thereof.

6. Particles according to claim 1 wherein the oxidizing material is present in an amount from about 2 to about 40% by weight.

7. Particles according to claim 1 wherein sodium tripolyphosphate is the inorganic diluent salt.

8. Particles according to claim 1 wherein the binder is present from about 10 to about 30% by weight.

9. A detergent composition comprising from about 0.5 to about 80% by weight of hard spherical bleaching particles according to claim 1 and from about 2 to about 50% by weight of a surfactant selected from the group consisting of anionic, nonionic, zwitterionic, amphoteric, cationic surfactants and mixtures thereof.

10. A detergent composition according to claim 9 further comprising from about 2 to about 80% of an organic or inorganic builder salt.

11. A method for bleaching substrates comprising applying the hard spherical bleaching particles of claim 1 suspended in an aqueous medium to said substrate.

12. A method according to claim 11 wherein the substrate is selected from the group consisting of fabrics, dentures, metals, ceramics and wood.

13. A process for preparing the bleaching particles of claim 1 comprising the steps of:

(i) mixing said oxidizing material, inorganic diluent salt and binder in a heated vessel to produce said core particles;

(ii) charging said core particles to a fluid bed dryer; and (iii) spraying a solution of said alkali metal $C_{16}$–$C_{18}$ fatty acid soap and $C_{12}$–$C_{14}$ alkali metal fatty acid soap coating mixture onto said core particles undergoing agitation in the fluid bed dryer, said solution comprising from about 0.5 to about 50% by weight of said soap mixture and about 50% to about 99.5% by weight of a low-boiling organic solvent.

14. A process according to claim 13 wherein said solvent is selected from the group consisting of low boiling alcohols, hydrocarbons, halocarbons, ethers, esters and mixtures thereof.

15. A process according to claim 14 wherein the solvent is selected from methanol, acetone and mixtures thereof.

16. A process according to claim 13 wherein the solvent has a boiling point of from about 40° F. to about 250° F.

17. A process according to claim 16 wherein the solvent has a boiling point of from about 50° F. to about 180° F.

18. A process according to claim 13 wherein the fluid bed is maintained at a temperature of from about 50° F. to about 300° F.

19. A process according to claim 13 wherein the temperature of the fluid bed dryer is maintained at from 10° F. to about 200° F. greater than the boiling point of said solvent.

20. A process according to claim 13 wherein soap is present in the solution from about 5% to about 40% by weight of the solution.

* * * * *